US005633035A

United States Patent [19]

Baba et al.

[11] Patent Number: 5,633,035

[45] Date of Patent: *May 27, 1997

[54] THIN-FILM RESISTOR AND PROCESS FOR PRODUCING THE SAME

[75] Inventors: Kazuo Baba; Yoshiyuki Shiratsuki; Kumiko Takahashi, all of Kanagawa, Japan

[73] Assignee: Fuji Xerox Co., Ltd., Tokyo, Japan

[ * ] Notice: The term of this patent shall not extend beyond the expiration date of Pat. No. 5,053,249.

[21] Appl. No.: 428,835

[22] Filed: Apr. 25, 1995

Related U.S. Application Data

[63] Continuation of Ser. No. 220,463, Mar. 31, 1994, abandoned, which is a continuation of Ser. No. 463,123, Jan. 10, 1990, abandoned, which is a division of Ser. No. 347,698, May 5, 1989, abandoned.

[30] Foreign Application Priority Data

May 13, 1988 [JP] Japan ..... 63-116444

[51] Int. Cl.[6] ..... B05D 5/12

[52] U.S. Cl. ..... 427/101; 427/126.1; 427/126.5; 427/226

[58] Field of Search ..... 427/101, 126.1, 427/126.5, 376.2, 226; 252/518

[56] References Cited

U.S. PATENT DOCUMENTS

| | | | |
|---|---|---|---|
| Re. 28,820 | 5/1976 | Beer | 427/126.5 |
| 2,645,701 | 7/1953 | Kerridge | 427/101 |
| 3,539,392 | 11/1970 | Cockbain | 427/101 |
| 3,619,287 | 11/1971 | Stankavich | 427/101 |
| 3,620,840 | 11/1971 | Schroeder et al. | 252/514 |
| 3,673,117 | 6/1972 | Schroeder et al. | 252/513 |
| 3,681,261 | 8/1972 | Mason et al. . | |
| 3,809,797 | 5/1974 | McMunn | 252/514 |
| 4,221,826 | 9/1980 | Baltrushaitis | 252/518 |
| 4,233,340 | 11/1980 | Saito | 427/126.5 |
| 4,302,362 | 11/1981 | Hoffman | 106/1.05 |
| 4,330,331 | 5/1982 | Fujiwara | 427/126.5 |
| 4,362,656 | 12/1982 | Hormadaly | 427/101 |
| 4,415,624 | 11/1983 | Prabhu et al. | 252/518 |
| 4,476,039 | 10/1984 | Hormadaly | 252/519 |
| 4,539,223 | 9/1985 | Hormadaly | 427/102 |
| 4,574,056 | 3/1986 | Kimura et al. | 252/506 |
| 4,668,299 | 5/1987 | Nanao | 106/287.19 |
| 4,720,394 | 1/1988 | Kojima | 427/102 |
| 5,053,249 | 10/1991 | Baba | 427/101 |
| 5,189,284 | 2/1993 | Takahashi | 427/126.1 |

FOREIGN PATENT DOCUMENTS

| | | |
|---|---|---|
| 2192361 | 2/1974 | France . |
| 1490606 | 7/1970 | Germany . |
| 3814236 | 11/1988 | Germany . |

OTHER PUBLICATIONS

Communication from European Patent Office dated Oct. 7, 1992.

*Primary Examiner*—Shrive Beck
*Assistant Examiner*—Brian K. Talbot
*Attorney, Agent, or Firm*—Finnegan, Henderson, Farabow, Garrett & Dunner, L.L.P.

[57] ABSTRACT

A thin-film resistor comprising a mixture of rhodium (Rh) oxide as a resistive material, and at least one element M selected from the group consisting of silicon (Si), lead (Pb), bismuth (Bi), zirconium (Zr), barium (Ba), aluminium (Al), boron (B), tin (Sn), and titanium (Ti), wherein M/Rh, or the ratio of the number of element M atoms to that of rhodium (Rh) atoms is in the range of 0.3 to 3.0. Thin-film resistor is formed from the process of preparing a solution of an organometallic material, coating the material on a substrate, drying and then firing the material at a peak temperature not less than 500° C.

4 Claims, 1 Drawing Sheet

THIN-FILM RESISTOR AND PROCESS FOR PRODUCING THE SAME

This application is a continuation of prior application Ser. No. 08/220,463 filed Mar. 31, 1994 now abandoned, which is a continuation of application Ser. No. 07/463,123 filed Jan. 10, 1990, now abandoned, which is a divisional of application Ser. No. 07/347,698 filed May 5, 1989, now abandoned.

BACKGROUND OF THE INVENTION

1. Field of the Invention

The present invention relates to a resistor for use in hydrid ICs and various other electronic devices and a process for producing the resistor. Specifically, the invention relates to a thin-film uniform resistor and a process for producing the same.

2. Description of the Related Art

There have been two basic approaches for fabricating resistors useful in electronic devices such as hybrid ICs and thermal heads. One method is a thick-film process in which a coating of thick-film resistor paste is formed on a substrate which is then fired to make a resistor, and the other method is a thin-film process employing sputtering or other thin-film depositing techniques.

In a thick-film process, a powder mixture of ruthenium oxide and glass frit is dispersed in an organic vehicle made of a solvent and a resin, and the resulting thick-film resistor paste is screen-printed on a substrate, which is then fired to make a resistor.

In a thin-film process, which employs vacuum deposition technology, a thin film of a refractory metal such as tantalum, is deposited on a substrate by sputtering, and a patterned, thin-film resistor is fabricated by photolithographic techniques. This method is used to fabricate some of the thermal heads in current use.

The conventional thick-film process which uses thick-film resistor paste has the advantage of achieving high production rate with inexpensive facilities. However, on account of their large thickness (≧10 μm) and because of the lack of homogeneity of the thick-film paste which is made of glass frit and ruthenium oxide powder, the resistors produced by this process have the problem of low stability to an electic field, i.e. their resistance changes sharply when they are subjected to voltage variations.

Furthermore, the thick-film process has the following additional disadvantages; the resistance value of the final product cannot be effectively controlled by adjusting the proportions of glass frit and ruthenium oxide alone, also great variations in resistance will occur, not only because of the difference in the particle sizes of glass frit and ruthenium oxide powder, but also, upon the firing temperature used. Even if the same compositional range and average particle size are used, the value of resistance will differ from one lot to another.

The thin-film process is capable of producing uniform thin-film resistors but, on the other hand, this method requires expensive facilities, and achieves only a low production rate.

SUMMARY OF THE INVENTION

It is an object of the present invention to provide a thin-film resistor, that overcomes the aforementioned problems, produced by a thick-film process and a process for making the same.

The thin-film resistor, and the method of production of the same resistor, in accordance with the present invention will provide the following advantages over that of known film resistors. It is to be understood that this list is exemplary in nature and the advantages are not limited to what is listed herein.

(1) The thin-film resistor of the present invention can be fabricated as a uniform thin-film resistor, although the production appartus is no more expensive than that employed in the manufacture of conventional glass frit based thick-film resistors.

(2) The resistance value presented by the thin-film resistor of the present invention is substantially determined by the proportions of metals used, the firing conditions employed and the film thickness, and there is no need to take into account the effects of other parameters, including lot-dependent variations.

(3) The thin-film resistor of the present invention experiences smaller power-dependent variations in resistance than prior art thick-film resistors. During discharge as of a capacitor, the prior art resistors have experienced decrease in the value of resistance. In contrast, the thin-film resistor of the present invention will not suffer from this problem, and hence, features a higher reliability as exemplified by immunity to static, or noise caused by other means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects and advantages, and in accordance with the purposes of the invention as embodied and broadly described herein, there is provided a thin-film resistor comprising a mixture of rhodium (Rh) oxide as a resistive material, and at least one element M selected from the group consisting of silicon (Si), lead (Pb), bismuth (Bi), zirconium (Zr), barium (Ba), aluminium (Al), boron (B), tin (Sn), and titanium (Ti), wherein M/Rh, or the ratio of the number of element M atoms to that of rhodium (Rh) atoms is in the range of 0.3–3.0. This thin-film resistor is formed from the process of preparing a solution of an organometallic material containing rhodium (Rh), and at least one element M selected from the group consisting of silicon (Si), lead (Pb), bismuth (Bi), zirconium (Zr), barium (Ba), aluminum (Al), boron (B), tin (Sn), and titanium (Ti), wherein M/Rh, or the ratio of the number of element M atoms to that of rhodium (Rh) atoms is in the range of 0.3 to 3.0; adjusting the viscosity of the solution to 5,000–30,000 cPs; coating the organometallic material on a substrate; drying of the organometallic material coated on the substrate; and firing, in air, the organometallic material coated on the substrate at a peak temperature higher than 500° C.

The accompanying drawings, which are incorporated in and constitute a part of the specification, illustrate a presently preferred embodiment of the invention and, together with the general description given above and the detailed description of the preferred embodiment given below, serve to explain the principles of the invention.

DESCRIPTION OF THE PREFERRED EMBODIMENT

Figure 1:
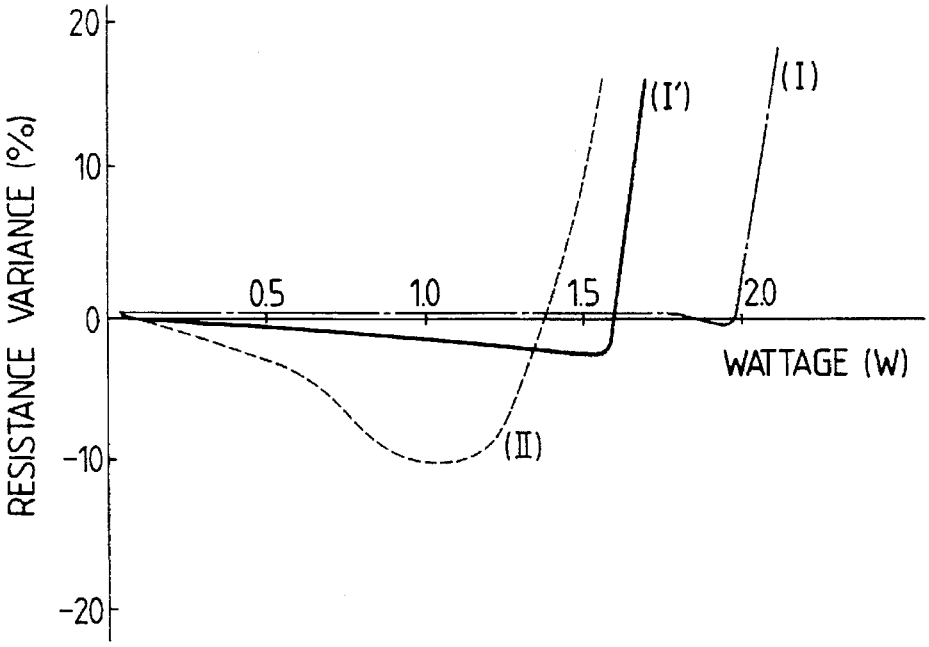
FIG. 1 shows the results of strength measurements conducted by a step stress test on resistor samples of the present invention and a prior art resistor.

In accordance with the present invention, there is provided, a thin-film resistor that contains rhodium oxide as a resistive material. Preferably, this thin-film resistor is formed as follows: A solution of an organometallic material containing as resistive materials, not only rhodium (Rh), but also, at least one element M selected from the group consisting of silicon (Si), aluminium (Al), barium (Ba), tin (Sn), titanium (Ti), zirconium (Zr), boron (B), lead (Pb) and bismuth (Bi) in such amounts that M/Rh, or the ratio of the number of metal atoms to that of rhodium atoms, is in the range of 0.3 to 3.0. The resulting organometallic material solution is then coated onto a substrate followed by the drying of that organometallic material solution.

The solution coated substrate is then fired in air at a peak temperature not lower than 500° C.

The resulting resistor contains rhodium oxide ($RhO_2$), with the other metals forming a homogeneous structure in the form of their oxides or ternary oxides of them and rhodium.

EXAMPLE

An example of the present invention is described below in detail. "Metal Resinate" (trade name of Engelhard Minerals & Chemicals Corporation) of the following identification numbers were used as solutions of organometallic material:

| | | | |
|---|---|---|---|
| Rh . . . | # 8826 | Si . . . | # 28-FC |
| Al . . . | # A-3808 | Ba . . . | # 137-C |
| Sn . . . | # 118-B | Ti . . . | # 9428 |
| Zr . . . | # 54237 | B . . . | # 11-A |
| Pb . . . | # 207-A | Bi . . . | # 8365 |

These solutions were mixed in such porportions such that the ratio between the numbers of respective atoms would lie at certain values as shown in Table 1. The viscosity of the mixture was adjusted to 5,000–30,000 cPs by using a resin such as ethyl cellulose and a solvent such as α-terpineol or butylcarbitol acetate. The resulting mixture was coated onto a glazed ceramic ($Al_2O_3$) substrate using a stainless steel wire screen of 150–400 mesh. After drying at 120° C., the coated substrate was fired in an ir belt furnace for 10 minutes at a peak temperature of approximately 500°–800° C. to form a resistor film on the substrate. The resulting resistor films had thicknesses ranging from 0.05 to 0.3 μm.

The sheet resistances of some of the resistors fabricated in the example under consideration are shown in Table 1. The data in Table 1 refers to the films that were prepared using as a vehicle a mixture composed of 70 wt % solvent and 30 wt % resin; printing was done with a screen of 200 mesh and subsequent firing was conducted at a peak temperature of 800° C.

TABLE 1

RESISTOR COMPOSITIONS AND SHEET RESISTANCE

| SAMPLE | COMPOSITION (ATOMIC RATIO) Rh | Si | Bi | Pb | OTHERS | VEHICLE Wt % | SHEET RESISTANCE Ω/□ |
|---|---|---|---|---|---|---|---|
| A | 1 | 0.5 | 0.5 | — | — | 50 | 1.2k |
| B | 1 | 0.7 | 0.5 | — | — | " | 1.1k |
| C | 1 | 0.5 | 0.3 | — | — | " | 1.7k |

TABLE 1-continued

RESISTOR COMPOSITIONS AND SHEET RESISTANCE

| SAMPLE | COMPOSITION (ATOMIC RATIO) Rh | Si | Bi | Pb | OTHERS | VEHICLE Wt % | SHEET RESISTANCE Ω/□ |
|---|---|---|---|---|---|---|---|
| D | 1 | 0.5 | 0.7 | — | — | " | 1.7k |
| E | 1 | 1 | 0.5 | — | — | " | 1.9k |
| F | 1 | 1 | 1 | — | — | 70 | 6.9k |
| G | 1 | 0.5 | 1 | — | — | " | 4.6k |
| H | 1 | 0.3 | 1 | — | — | " | 4.2k |
| I | 1 | 1 | 0.3 | — | — | " | 11.7k |
| J | 1 | 0.3 | 0.5 | — | — | " | 2.1k |
| K | 1 | 0.2 | 0.1 | — | — | " | 2.5k |
| L | 1 | 0.1 | 0.1 | — | — | 70 | 3.0k |
| M | 1 | 1 | — | 0.5 | — | " | 4.5k |
| N | 1 | 1 | — | 1 | — | " | 3.4k |
| O | 1 | 0.3 | — | 0.5 | — | " | 786 |
| P | 1 | 0.5 | — | 1 | — | " | 1.38 |
| Q | 1 | 1 | 1 | 1 | — | " | 10.5k |
| R | 1 | 0.5 | 1 | 1 | — | " | 7.1k |
| S | 1 | 0.5 | — | — | Zr0.5 | " | 42.1k |
| T | 1 | 0.7 | — | — | Ba0.3 | " | 2.0k |
| U | 1 | 0.5 | 0.5 | — | Al0.3 | " | 3.7k |
| V | 1 | 0.5 | 0.5 | — | B0.3 | " | 3.7k |
| W | 1 | 0.5 | 0.5 | — | B0.5 | " | 4.4k |
| W' | 1 | 0.5 | 0.5 | — | Sn0.3 | " | 2.4k |
| X | 1 | 0.5 | — | 0.5 | Al0.3 | " | 1.1k |
| Y | 1 | 0.5 | — | 0.5 | B0.3 | " | 1.2k |
| Z | 1 | 0.5 | — | 0.5 | Zr0.3 | " | 32.9k |
| Z' | 1 | 0.5 | — | 0.5 | Ti0.3 | " | 9.9k |

If M/Rh is less than 0.3, a continuous film is not obtainable. For example, if M/Rh is 0, the resulting film will separate from the glazed ceramic substrate. If M/Rh is 0.2 as shown under L in Table 1 (Rh:Si:Bi =1:0.1::0.1), cracking develops in the film and this causes not only an apparent increase in the sheet resistance of the film, but also variations in its resistance from lot to lot. If M/Rh exceeds 3.0, the resulting film will become an electrical insulator, rather than a resistor. Therefore, the value of M/Rh is preferably selected from the range of 0.3 to 3.0.

In the Example shown above, various types of "Metal Resinate" available from Engelhard Minerals & Chemicals Corporation were used. However, it should be understood that there are a number of various other types of solutions of organometallic materials suitable. These materials can be prepared from complexes of rhodium or other metals, such as Si, Bi, and Pb, with an organic material such as carboxylic acids, which are soluble in organic solvents such as α-terpineol and butylcarbitol acetate. Suitable metal complexes are listed below.

For rhodium complexes, the following complexes with carboxylic acids, cyclic terpene mercaptides, β-diketones, etc. may be given:

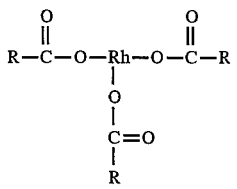

(I)

-continued (II)

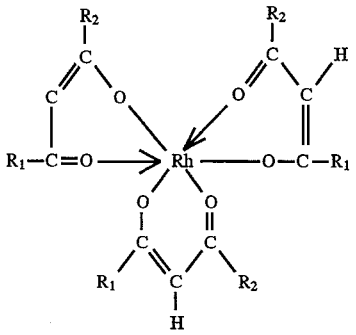

(III)

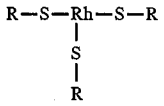

For Si complexes,

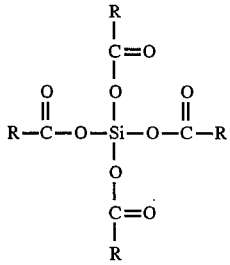

and low-molecular weight silicone resins and silicon alkoxides may be used.

For Bi complex:

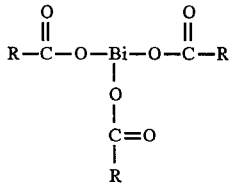

For Pb complex:

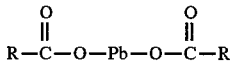

As complexes of other metals, carboxylic acid complexes

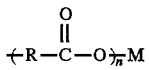

and metal alkoxides

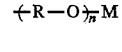

may be given.

In FIG. 1, heating film resistors (I) and (I') had ratios of Rh:Si:Bi=1:0.5:0.5 and were prepared by heating at peak temperatures of 800° C. and 500° C., repectively. Curve (II) represents a conventional ruthenium oxide based heating film resistor. All three were subjected to strength measurements by a step stress test (SST). The results are shown in FIG. 1, in which the horizontal axis plots power wattage (W) and the vertical axis, resistance variance (%).

Strength measurements by SST are well known and involve investigation of resistance variance in response to changes in electrical power. In the test, the results of which are shown in FIG. 1, 1-ms wide pulses were applied with 10 ms repetition. 1000 pulses were applied for each power, and then the pulse hight was increased to change to applied voltage. Change in resistance was measured.

Heating resistors (I) and (I') measured 100 μm×150 μm and had a film thickness of 0.15 μm. The values of their resistance were each 2.0 (Rh:Si:Bi=1:0.5:0.5). Conventional film resistor (II) measured the same resistance, but its film thickness was 15 μm.

As is clear from FIG. 1, the two samples of heating resistor fabricated in accordance with the present invention experienced very small changes in resistance in spite of power variation. In other word, these resistors had remarkably increased stability to electrical power and hence improved device reliability.

Figure 2:
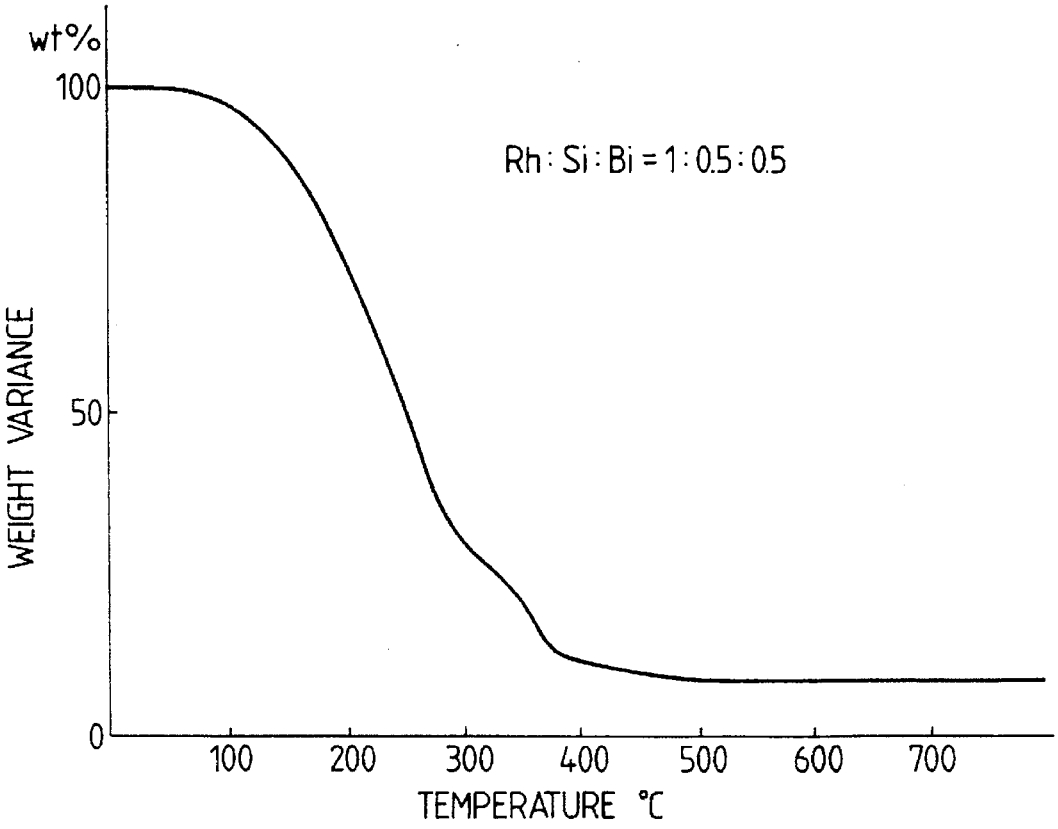
FIG. 2 shows the characteristic curve when the firing temperature is plotted against the weight profile of the resistor of the present invention.

In the process of the present invention, the coated substrate is fired at a peak temperature of not lower than 500° C. If the firing temperature is below 500° C., greater difficulty is involved in forming a desired resistor film. This is evident from the results of thermogravimetric analysis of resistor film shown in FIG. 2 for a resinate having a Rh:Si:Bi value of 1:0.5:0.5. At 500° C. and above, the weight of the film remained practically constant, suggesting the completion of film formation for heating resistor.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

What is claimed is:

1. A process of forming a thin-film resistor comprising rhodium (Rh) oxide as a resistive material, comprising the steps of:

preparing a solution of ethyl cellulose, an organic solvent, an organometallic material containing rhodium (Rh), and an organometallic material containing at least one element selected from the group consisting of silicon (Si), lead (Pb), bismuth (Bi), zirconium (Zr), barium (Ba), aluminum (Al), boron (B), tin (Sn), and titanium (Ti), wherein the ratio of the total number of metal atoms other than rhodium (Rh) atom (M) to that of rhodium (Rh) atoms (M/Rh), is in the range of 0.3 to 3.0;

applying onto a substrate a coating consisting essentially of said solution;

drying said solution coated on said substrate; and firing, in air, said solution coated on said substrate after drying to form on said substrate a thin-film resistor formed of a homogeneous structure of oxides of said at least one element and rhodium oxide.

2. The proces of claim 1, wherein said step of drying of said solution of an organometallic material coated on said substrate takes place at a temperature of approximately 120° C.

3. The process of claim 1, wherein said step of firing of said organometallic material coated on said substrate is of a duration of approximately ten minutes.

4. The process of claim 1, wherein said step of firing of said organometallic material coated on said substrate is at a temperature range of 500°–800° C.

* * * * *